United States Patent [19]

Beach et al.

[11] Patent Number: 4,850,649

[45] Date of Patent: Jul. 25, 1989

[54] ROTATABLE CUTTING BIT

[75] Inventors: Wayne H. Beach, Roaring Spring; Robert H. Montgomery, Baden; Lawrence R. Burns, Latrobe, all of Pa.

[73] Assignee: Kennametal Inc., Latrobe, Pa.

[21] Appl. No.: 246,891

[22] Filed: Sep. 16, 1988

Related U.S. Application Data

[63] Continuation of Ser. No. 916,336, Oct. 7, 1986, abandoned.

[51] Int. Cl.[4] ..... E21C 35/18

[52] U.S. Cl. ..... 299/92; 299/86

[58] Field of Search ..... 299/79, 86, 91, 92, 299/93; 37/142 A; 411/517, 521

[56] References Cited

U.S. PATENT DOCUMENTS

| | | | |
|---|---|---|---|
| 4,327,947 | 5/1982 | Bower, Jr. | 299/92 X |
| 4,335,921 | 6/1982 | Swisher, Jr. et al. | 299/92 X |
| 4,484,783 | 11/1984 | Emmerich | 299/92 X |
| 4,684,176 | 8/1987 | Den Besten et al. | 299/91 |
| 4,728,153 | 3/1988 | Ojanen et al. | 299/92 |

FOREIGN PATENT DOCUMENTS

| | | | |
|---|---|---|---|
| 3401243 | 8/1984 | Fed. Rep. of Germany | 299/86 |

*Primary Examiner*—Jerome W. Massie, IV
*Assistant Examiner*—David J. Bagnell
*Attorney, Agent, or Firm*—Thomas R. Trempus

[57] ABSTRACT

A rotatable cutting tool for mounting in the bore of a block comprising an elongate symmetrical body having forward and rearward portions wherein the forward portion terminates in a front end at which there is a cutting tip and the rearward portion is of a generally constant diameter and terminates in a rear end. The rearward portion contains a channel adjacent the rear end. A resilient retainer surrounds substantially all of the rearward portion and extends rearwardly past the rear end. The retainer has an inward projection which is received within the channel so that the elongate body and retainer are retained together. The retainer has an unstressed diameter greater than the diameter of the bore so that when the cutting tool is inserted into the bore the retainer expands against the bore so as to be held therein whereby the body is free to rotate relative to the block.

24 Claims, 2 Drawing Sheets

ROTATABLE CUTTING BIT

This is a continuation of co-pending application Ser. No. 916,336 filed on Oct. 7, 1986 now abandoned.

BACKGROUND OF THE INVENTION

The invention is directed to an earth working, mining, or construction bit, and more particularly, to a cutting bit designed to be held in a mounting block that is affixed to a movable member.

Rotatable cutting bits held within a mounting block affixed to a movable member, such as a mining wheel or road planing drum, have been utilized to perform various excavating operations. These excavating operations can include applications relating to the removal of minerals as well as applications relating to road planing, trenching, concrete cutting and other construction applications. While earlier devices have performed satisfactorily, certain problems or drawbacks have existed, and the present invention is an improved design directed to successfully overcoming these drawbacks.

Typical cutting bits that have been previously utilized have included an enlarged diameter portion or a sharp stepped or flanged diameter portion at the rear end of the shank such as those illustrated in U.S. Pat. No. 4,201,421 to Den Besten et al. or in U.S. Pat. No. 3,519,309 to Engle et al., for example. In manufacturing the rearward portion of the bit body via techniques such as cold heading, forging or machining, it has been found that it is more economical to avoid forming such an enlarged diameter portion. It would thus be advantageous to provide a cutting bit wherein the rearward portion of the bit body is of a substantially constant diameter thereby eliminating an enlarged or sharp stepped diameter portion.

In previous cutting bits having such enlarged or sharply stepped diameter portions, it has been found that when the bit is extracted from the block, the sleeve can become positioned between the enlarged or stepped diameter portion and the cylindrical bore wall wedging the sleeve into the bore making it virtually impossible to easily extract the bit from the block and usually requiring the block to be removed and replaced. As can be appreciated, undesirable additional expense is associated with removing and then replacing the block resulting in unnecessary and expensive down time.

Earlier cutting bits have utilized the enlarged diameter or sharply stepped rearward portion of the bit as an abutment to retain a cylindrical retainer or clip captive on the bit. In operation of the previous bits and retainers, the rearward portion of the bit contacts the cylindrical wall of the bore so that wear on certain portions of the bore occurs as the bit rotates in the mounting block. It would thus be advantageous to provide a retainer wear sleeve which protects the bore of the block from wear due to contact with the shank of the cutting bit during operation. Such a retainer wear sleeve would increase the life of the block since contact between the shank and the bore of the block would be reduced.

During the cutting operation, a large volume of particulate materials are generated. These particulates tend to infiltrate the bore of the block-bit assembly, and collect in the volume between the rear shank and retainer wear sleeve. Earlier cutting bits having an enlarged diameter or sharply stepped rearward portion have trapped these contaminants and impaired the ability of the bit either to rotate in the bore of or to be efficiently removed from the block. Consequently, it would be advantageous to provide a cutting bit that does not have an enlarged diameter or sharply stepped rearward portion so that the tendency of particulate material being trapped between the sleeve and the shank is reduced.

In order to insert previous cutting bits having the enlarged diameter or sharply stepped rearward portion into the bore of the block, the rearward portion is aligned with the bore of the block and the bit driven into the bore. Earlier retainers for cutting bits have not provided any means to assist in guiding the bit into the bore of the mounting block. It would thus be advantageous if a retainer for a cutting bit did provide a means for guiding the bit into the bore and also protected the bore of the block from wear or distortion.

SUMMARY OF THE INVENTION

It is an object of the invention to provide an improved retainer and cutting bit which may be rotatably held within the bore of a mounting block affixed to a movable member.

It is another object of the invention to provide a cutting bit that is more economical to manufacture.

It is another object of the invention to provide such a retainer and cutting bit that it is easy to extract from the bore of the block.

It is another object of the invention to provide such a retainer and rotatable cutting bit that does not trap particulate matter between the retainer sleeve and the rear shank of the bit.

Finally, it is another object of the invention to provide a retainer and a cutting bit whereby the retainer provides a means to guide the bit into the bore of the mounting block.

In one form thereof, the invention is a retainer and a cutting tool or bit for mounting in the bore of a block wherein the tool comprises an elongate bit body generally symmetrical about a longitudinal axis. An elongate body has forward and rearward portions wherein the forward portion terminates in a front end at which there is a cutting tip and the rearward portion is of a generally constant diameter and terminates in a rear end. The rearward portion contains an annular channel adjacent the rear end thereof. A resilient retainer surrounds substantially all of the peripheral rearward shank portion and extends rearwardly past the rear end and has an inward projection or projections received within the channel so that the elongate body and retainer are retained together. The retainer has an unstressed diameter greater than the diameter of the bore so that when the cutting tool is inserted into the bore the retainer expands against the bore so as to be held therein.

In another form therein, the invention is a resilient retainer for mounting a cutting bit in a cylindrical bore of a block wherein the retainer comprises an elongate cylindrical sleeve having opposite front and rear ends. The sleeve is axially split along the entire length thereof and has integral forward intermediate and rearward portions. The forward portion is of a substantially constant diameter and the rearward portion is tapered radially inwardly whereby the rear end is of a diameter less than that of the intermediate and forward portions and also in an unstressed condition less than the diameter of the bore of the block. A radially inward projection adapted to engage the cutting bit is formed in the intermediate or forward portion. The intermediate and/or forward portions of the retainer have an unstressed diameter greater than the diameter of the bore so that when the cutting tool is inserted into the bore the retainer expands against the bore so as to be held therein whereby the cutting bit may be free to rotate relative to the bore of the block.

In another form thereof, the invention is a cutting assembly comprising a cutter bit mounted in a block having a cylindrical bore of a first diameter and a rotatable cutting tool having an elongate body generally symmetrical about a longitudinal axis. The elongate body has forward and rearward portions wherein the forward portion terminates in a front end at which there is a cutting tip and the rearward portion is of a generally constant diameter and terminates in a rear end. The rearward portion contains an annular channel. A resilient retainer surrounds substantially all the rearward portion and extends rearwardly past the rear end. The retainer has an inward projection received within the channel so that the elongate body and retainer are retained together. The retainer has an unstressed third diameter greater than the first diameter of the bore so that when the cutting tool is inserted into the bore the retainer expands against the bore so as to be held therein whereby the body is free to rotate relative to the block.

Because the retainer has inward projection which engage the bit body, it is not necessary for the forward portion of the retainer to be arranged so as to be in an abutting relation with a forward shoulder portion of the bit.

BRIEF DESCRIPTION OF THE DRAWINGS

The above-mentioned and other features and objects of this invention and the manner of attaining them will become more apparent and the invention itself will be best understood by reference to the following description of an embodiment of the invention taken in conjunction with the accompanying drawings.

DETAILED DESCRIPTION OF SPECIFIC EMBODIMENTS

Figure 1:
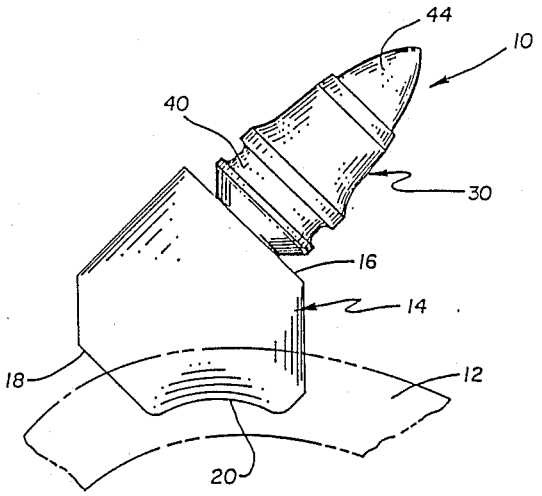
FIG. 1 is a side view of a cutting bit-block assembly wherein the cutting bit is inserted into the block and the block is affixed to a movable member.

Referring to the drawings, there is illustrated in FIG. 1 a cutting assembly generally designated as 10 which is mounted to a rotatable or movable member 12. Although not intended to be limiting, the rotatable or movable member may comprise a mining wheel, a road planing drum a bucket blade, a grader blade or the like. The cutting assembly 10 includes a block 14 having a front face 16, a rear face 18, and a mounting face 20. Block 14 further includes a generally cylindrical bore 22 having a frusto-conically shaped seating surface 24 adjacent the front face 16 thereof. As can be appreciated from FIG. 1, the block is affixed at the mounting face 20 to the rotatable member 12 such as by welding or the like.

Figure 2:
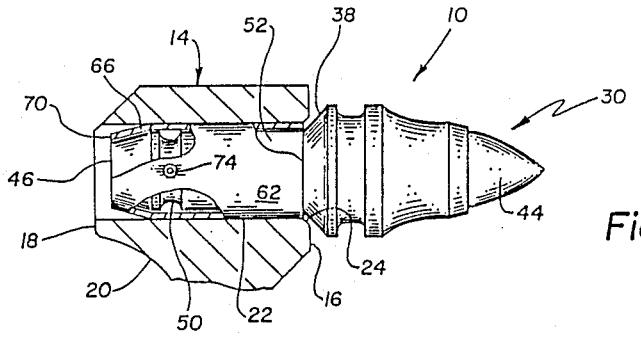
FIG. 2 is a sectional side view of the cutting assembly of FIG. 1.
Figure 4:
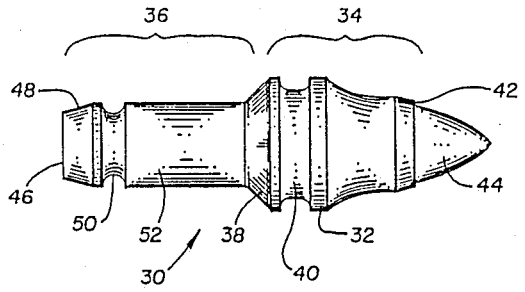
FIG. 4 is a side view of the cutting bit body of FIG. 1.

Cutting assembly 10 further includes a cutting bit generally designated as 30. Referring to FIGS. 2 and 4, cutting bit 30 includes an elongate steel body 32 having integral forward and rearward portions 34 and 36, respectively. An annular frusto-conically shaped shoulder 38 joins the forward and rearward portions. Body 32 further includes an annular puller groove 40 positioned forwardly of annular shoulder 38. Puller groove 40 is designed to receive a tool, well known to those in the art, which facilitates the removal of the cutting bit from the block.

Forward portion 34 includes a flat front face 42 having a socket (not illustrated) contained therein in which a cutting tip 44 is affixed such as by brazing. Cutting tip 44 is made from a hard material such as a cemented tungsten carbide.

The rearward portion 36 of steel body 32 terminates in a flat rear end 46 and has a frusto-conically shaped or tapered portion 48 adjacent the rear end 46. The rearward portion 36 contains an annular channel 50 positioned forwardly of the frusto-conically shaped portion 48. A constant diameter cylindrical portion 52 then joins the annular channel 50 with the annular shoulder 38.

Figure 7:
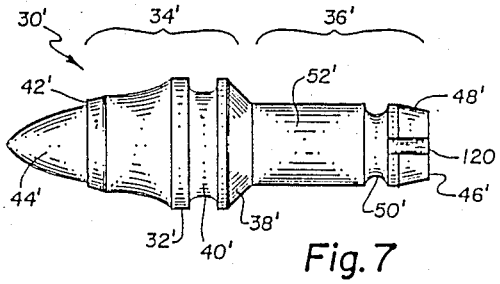
FIG. 7 is a side view of a second specific embodiment of the cutter bit body.
Figure 8:
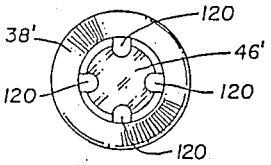
FIG. 8 is a rear plan view of the cutter bit body of FIG. 7.

Another specific embodiment of the cutting bit is illustrated in FIGS. 7 and 8. Elements in these specific embodiments that are common to one another are illustrated with the same reference numeral except that the reference numerals for the embodiment of FIGS. 7 and 8 are primed. The primary difference between the specific embodiment of FIGS. 7 and 8 than that illustrated in FIGS. 2 and 4 is the presence of a plurality of generally equi-spaced axial grooves 120 located in the frusto-conically shaped portion 48'. These grooves communicate with annular groove 50' and are open at the rear end 46'.

Figure 5:
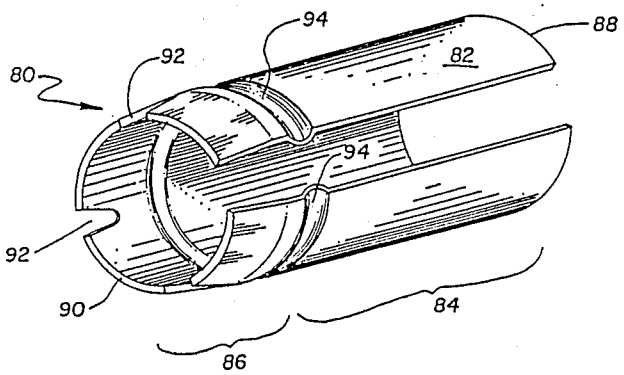
FIG. 5 is a perspective view of a second specific embodiment of the retainer wear sleeve.
Figure 6:
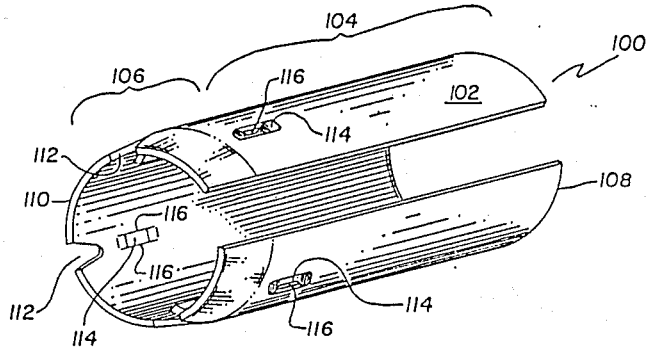
FIG. 6 is a perspective view of a third specific embodiment of the retainer wear sleeve.

As illustrated in FIG. 2, a retainer surrounds substantially all of the rearward portion 36 of the cutting bit body 32. The retainer serves two basic purposes. The first is to retain the bit body in the block, and the second is to protect the block from wear by functioning as a wear sleeve between the bit body and block. Several specific embodiments of the retainer are illustrated in FIGS. 3, 5 and 6, and each will be described below.

Figure 3:
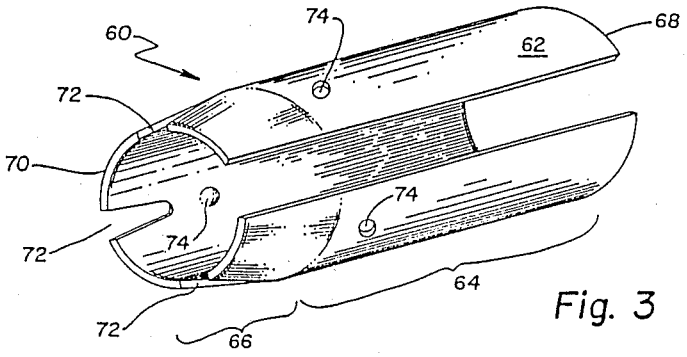
FIG. 3 is a perspective view of one specific embodiment of the retainer wear sleeve of FIG. 2.

Referring to FIG. 3, one specific embodiment of the retainer, generally designated as 60, comprises an elongate sleeve 62 having a forward portion 64 and a rearward portion 66. The forward portion 64 terminates in a generally circularly-shaped front edge 68 and the rearward portion 66 terminates in a generally circularly-shaped rear edge 70. The rearward portion 66 is crimped in a radially inward direction as illustrated in FIG. 3 so that the rearward portion 66 takes on a general frusto-conical shape. Rearward portion 66 includes a plurality of axial slots 72 which facilitate the crimping of the rearward portion.

The forward portion 64 of sleeve 64 contain a plurality of radially inwardly projecting dimples 74 positioned forwardly of the juncture between the forward and rearward portions 64,66 of the sleeve 62. As can be appreciated from FIG. 2, the retainer 60 is positioned relative to the cutting bit body 32 so as to surround the rearward portion 36 thereof whereby the dimples 74 are received within the annular channel 50.

The diameter of the forward portion 64 of retainer 60 in an unstressed condition is larger than the diameter of bore 22 of block 14. Consequently, when the assembly of the cutting bit body and the retainer is inserted into the bore, the diameter of the forward portion 64 of the retainer 60 is radially compressed whereby when inside the bore, the retainer 60 expands against the bore so as to be securely held therein. Dimples 74 are received within annular groove 70 so as to retain the cutting bit body and retainer together. The dimensioning of the dimples 74 relative to the annular channel 50 and the sleeve itself relative to the rearward portion of the cutting bit body are as such that the cutting bit is free to rotate relative to the retainer and the block when the cutting bit-retainer assembly is inserted into the bore of the block. As can be appreciated, the cutting bit body is rotatably retained by the retainer which is securely held in the bore of the block. The end result being that the bit is rotatably mounted within the block.

Referring to FIG. 5, there is illustrated another specific embodiment of a retainer, generally designated as 80, comprising an elongate sleeve 82 having a forward portion 84 and a rearward portion 86. The forward portion 84 terminates in a generally circularly-shaped front edge 88 and the rearward portion 86 terminates in a generally circularly-shaped rear edge 90. The rearward portion 86 is crimped in a radially inward direction as illustrated in FIG. 5 so that rearward portion 86 takes on a general frusto-conical shape. Rearward portion 86 further includes axial slots 92 which facilitate the crimping of rearward portion 86. Retainer 80 further includes a radially inwardly projecting annular projection 94 which extends around the circumference of retainer 80. Annular projection 94 is positioned at the juncture of the forward and rearward portions 84 and 86 of the sleeve 82.

Annular projection 94 is designed to be received within the annular channel 50 of the cutting bit and has the same general diametrical dimensioning as retainer 60. In other words, the unstressed diameter of the forward portion 84 of retainer 80 is larger than the diameter of bore 22 so that when the cutting tool assembly of the cutting bit and retainer re inserted into the bore, the retainer 80 expands against the surface of the bore 22 so as to be securely held therein. By virtue of annular projection 94 being received within annular channel 50, the cutting bit 30 is rotatably retained within retainer 80 and is free to rotate relative to the block during the cutting operation.

Referring to FIG. 6, there is illustrated another specific embodiment of the retainer, generally designated 100, comprising an elongate sleeve 102 having a forward portion 104 and a rearward portion 106. The forward portion 104 terminates in a generally circularly-shaped front edge 108 and the rearward portion 106 terminates in a generally circularly-shaped rear edge 110. The rearward portion 106 is crimped in a radially inward direction as illustrated in FIG. 6 so that the rearward portion takes on a general frusto-conical shape. Rearward portion 106 further contains a plurality of axial slots 112 therein which facilitate the crimping of rearward portion 106. Retainer 100 further includes a plurality of equi-spaced circumferential projections 114 which project radially inwardly and are received within channel 50 of the cutting bit. Each projection contains a pair of oppositely disposed apertures 116.

Like the earlier embodiments of the retainer, this retainer 100 has the forward portion 104 thereof being of an unstressed diameter that is greater than the diameter of the bore 22 of the block. Consequently, when the assembly of the cutting bit and retainer is inserted into the bore, the retainer expands against the bore so as to be securely held within. Projections 114 are received within annular channel 50 so as to rotatably retain the cutting bit body within the retainer, the end result being that the bit is rotatably mounted within the block.

Preferably the cutting bit assembly is mounted in the block so that the bit body is able to rotate relative to the block. This is accomplished by inserting the cutting bit assembly into the bore of the block so that, as previously described, the retainer is securely fixed within the bore and the cutting bit body is rotatably retained within the retainer by the reception of the projections within the channel. The end result being that the bit is able to rotate relative to the block during operation. The ability to rotate is one of the important operational features of the assembly since wear on the carbide tip more evenly occurs and flat spots on the tip are avoided.

As previously discussed with respect to all of the specific embodiments of the retainer, the rearward portion thereof is crimped in a radially inward direction so that the diameter of the rear edge of the retainer is less than the diameter of the bore. Because of this difference in the diameters of the rear edge and the bore and the frusto-conical shape of the rearward portion, the rearward portion of the retainer is easily positioned within the top portion of the bore prior to the cutting bit assembly being driven into the bore. Further, the rearward portion of the retainer acts to guide the cutting bit assembly into the bore upon insertion. The ability to guide the cutting bit assembly into the bore in the insertion process is a desirable feature not possessed by cutting bits having enlarged diameter or sharply stepped rear portions.

The rearward portion of the retainer extends over and rearwardly of the rear end of the cutting bit body and extends forwardly so as to surround substantially all of the rearward portion of the steel cutting bit body. As is appreciated, the retainer functions both as a retainer and a wear sleeve that protects the bit body and block from wear during the cutting operation. Because the retainer extends rearwardly past the rear end of the cutting bit, the bore is protected from wear caused by the rear end of the bit body.

During cutting operations, a lot of particulate contaminants can be generated and these contaminants infiltrate the cutting bit-block assembly so as to become lodged in the space that exists between the interior surface of the retainer and the surface of the rearward portion of the cutting bit body. In earlier cutting bits, as previously explained, the contaminants could be trapped in this space. As the volume of contaminants becomes greater, the ability of the cutting bit body to rotate relative to the retainer (and the block) becomes impaired. It can thus be appreciated that the entrapment and retention of contaminants discussed above is undesirable.

In the present structure, the rearward portion of the cutting bit body does not have an enlarged diameter portion by which contaminants are entrapped. Thus, contaminants found in the space between the rearward portion of the cutting bit body and the retainer will be able to exit this space over the rearward portion of the bit and a build-up of contaminants will not occur.

It has been found that contaminants are also located in the annular channel. Because there is no physical obstacle to the rearward exit of contaminants, contaminants found in the channel are removed therefrom by the projections or dimples and then exit over the frusto-conical portion (48,48') of the bit body. The specific embodiment of a retainer illustrated in FIG. 6 enhances the ability of the contaminants to be removed from the channel through the apertures 116 contained in the projections 114. These apertures 116 provide for direct travel of contaminants out of the channel.

Once the cutting bit has become useless, it must be removed from the block. Persons have used a special tool in cooperation with the puller groove to extract the cutting bit. Because the retainer extends rearwardly over the rear end of the bit body, there is eliminated the opportunity that existed in earlier bits for the retainer to become wedged between the bit and the wall of the bore thereby making simple extraction virtually impossible.

While there have been described above the principles of this invention in connection with specific apparatus, it is to be clearly understood that this description is made only by way of example and not as a limitation to the scope of the invention.

What is claimed is:

1. A cutting tool for mounting in the bore of a block, the cutting tool comprising:

an elongate body generally symmetrical about a longitudinal axis having forward and rearward portions, said forward portion terminating in a front end at which there is a cutting tip, said rearward portion being of a generally constant diameter and terminating in a rear end;

said rearward portion containing an annular channel adjacent the rear end;

a resilient retainer surrounding substantially all of the rearward portion and extending rearwardly past the rear end, said retainer comprising an elongate cylindrical sleeve being axially split along the entire length thereof, said sleeve having opposite front and rear ends, and an inward projection received within said channel so that the elongate body and retainer are retained together;

said cylindrical sleeve having an inwardly crimped portion which is generally frusto-conical in shape at the rear end thereof, said crimped portion extending over the rear end of said rearward body portion; and said retainer having an unstressed diameter greater than the diameter of the bore so that when the cutting tool is inserted into the bore the retainer expands against the bore so as to be held therein.

2. The cutting tool of claim 1 wherein said forward and rearward portions are joined together by an annular shoulder, and said rearward portion being of the diameter less than the maximum diameter of said annular shoulder.

3. The cutting tool of claim 1 wherein said inward projection is adjacent to said rear end of said sleeve.

4. The cutting tool of claim 3 wherein said crimped portion extends over and rearwardly past the rear end of said rearward body portion.

5. The cutting tool of claim 4 wherein the diameter of the rear end of the sleeve is less than the diameter of the bore.

6. The cutting tool of claim 4 wherein said sleeve contains an axial slot at the rear end thereof.

7. The cutting tool of claim 3 further including a plurality of circumstantially spaced inward projections.

8. The cutting tool of claim 7 wherein each of said projections contains an aperture communicating with the channel.

9. The cutting tool of claim 3 wherein said projection is an annular radially inwardly extending projection around the circumferential surface of said sleeve.

10. The cutting tool of claim 1 wherein said rearward portion contains an axial channel intersecting said annular channel and opening at the rear end whereby said axial channel communicates with the annular channel.

11. A resilient retainer for rotatably mounting a rotatable cutting bit in the cylindrical bore of a block comprising:

an elongate cylindrical sleeve having opposite front and rear ends, said sleeve being axially split along the entire length thereof, said sleeve having integral forward and rearward portions, said forward portion being of substantially constant diameter and said rearward portion being tapered radially inwardly so as to be generally frusto-conical in shape at the rear end thereof, whereby the rear end is of a diameter less than that of the forward portion, a radially inward projection adapted to engage the cutting bit being contained in the forward portion, and said retainer having an unstressed diameter greater than the diameter of the bore so that when the assembly of the cutting bit and retainer are inserted into the bore the retainer expands against the bore so as to be held therein.

12. The resilient retainer of claim 11 further including a plurality of circumferentially spaced inward projections.

13. The resilient retainer of claim 11 wherein said sleeve contains an axial slot at the rear end thereof.

14. The resilient retainer of claim 11 wherein the diameter of the rear end is less than the diameter of the bore.

15. A cutting assembly for being mounted to a rotatable cutter comprising:

a block having a cylindrical bore of a first diameter; a rotatable cutting tool having an elongate body generally symmetrical about a longitudinal axis and having forward and rearward portions, said forward portion terminating in a front end at which there is a cutting tip, said rearward portion being of a generally constant second diameter and terminating in a rear end;

said rearward portion containing an annular channel adjacent the rear end thereof;

a resilient retainer surrounding substantially all of the rearward portion and extending rearwardly past the rear end, said retainer comprising an elongate cylindrical sleeve being axially split along the entire length thereof and having opposite front and rear ends, said sleeve also having a radially inward projection received within said channel so that the elongate body and retainer are retained together;

said cylindrical sleeve having an inwardly crimped portion which is generally frusto-conical in shape at the rear end thereof, said crimped portion extending over the rear end of said rearward body portion; and said retainer having an unstressed third diameter greater than the first diameter of the bore so that when the cutting tool is inserted into bore the retainer expands against the bore so as to be held therein whereby the body is free to rotate relative to the block.

16. The cutting tool of claim 15 wherein said forward and rearward portions are joined together by an annular shoulder, and the second diameter of said rearward portion being less than the maximum diameter of said shoulder.

17. The cutting tool of claim 16 wherein said rearward portion contains an axial channel intersecting said annular channel and opening at the rear end whereby said axial channel communicates with the annular channel.

18. The cutting tool of claim 15 wherein said inward projection is adjacent to the rear end of said retainer.

19. The cutting tool of claim 18 wherein said crimped portion extends over and rearwardly past said rear end of said rearward body portion.

20. The cutting tool of claim 19 wherein said sleeve contains an axial slot at the rear end thereof.

21. The cutting tool of claim 18 further including a plurality of circumferentially spaced inward projections.

22. The cutting tool of claim 21 wherein each of said projections contains an aperture communicating with the channel.

23. The cutting tool of claim 18 wherein said projection is an annular radially inwardly extending projection around the circumferential surface of said sleeve.

24. A resilient retainer for rotatably mounting a rotatable cutting bit in the cylindrical bore of a block comprising:

an elongate cylindrical sleeve having opposite front and rear ends, said sleeve being axially split along the entire length thereof and having opposite front and rear ends with an inwardly crimped portion which is generally frusto-conical in shape at the rear and thereof, said sleeve surrounding substantially all of the rearward portion of the cutting bit, a radially inward projection adapted to engage a channel in the cutting bit being contained in the sleeve, said retainer having an unstressed diameter greater than the diameter of the bore so that when the assembly of the cutting bit and retainer are inserted into the bore the retainer expands against the bore so as to be held therein, and the retainer having a stressed diameter greater than the diameter of the surrounded rearward portion of the cutting bit so that the bit is able to rotate relative to the retainer when the bit-retainer assembly is inserted into the bore.

* * * * *